United States Patent [19]

Tachida et al.

[11] Patent Number: 4,641,565

[45] Date of Patent: Feb. 10, 1987

[54] UPRIGHT PIANO

[75] Inventors: Hiroki Tachida; Takane Sato; Shigeaki Sato, all of Shizuoka, Japan

[73] Assignee: Nippon Gakki Seizo Kabushiki Kaisha, Japan

[21] Appl. No.: 728,781

[22] Filed: Apr. 30, 1985

[30] Foreign Application Priority Data

May 1, 1984 [JP] Japan ..... 59-062985
Dec. 21, 1984 [JP] Japan ..... 59-192859

[51] Int. Cl.[4] ..... G10C 3/12

[52] U.S. Cl. ..... 84/431; 84/177; 84/186 R; 84/DIG. 3

[58] Field of Search ..... 84/431, 432, 17, DIG. 3, 84/176, 177, 186 R, 352, 354; 235/145 R; 312/14, 26, 30, 136, 282

[56] References Cited

U.S. PATENT DOCUMENTS 1,827,096 10/1931 Morse ..... 84/431
4,376,402 3/1983 Helpinstill, II ..... 84/431 X
4,550,638 11/1985 Kaneko et al. ..... 84/431

*Primary Examiner*—Benjamin R. Fuller
*Attorney, Agent, or Firm*—Ostrolenk, Faber, Gerb & Soffen

[57] ABSTRACT

In construction of a keyboard unit accommodable upright piano, a vertically turnable keyboard is held by a holder unit so that the keyboard unit can be stably held in a horizontal position at one state of the holder unit and easily be accommodated in the main casing at the other state of the holder unit.

9 Claims, 7 Drawing Figures

UPRIGHT PIANO

BACKGROUND OF THE INVENTION

The present invention relates to an improved upright piano, and more particularly relates to improvement in construction of an upright piano with a keyboard unit accommodatable in the main casing for easier transportation and storage.

An upright piano of the above-described type has already been proposed. In one well-known example, a keyboard unit is detachably or pivotally coupled to a pair of sides of the upright piano. More specifically, each side arm of the keyboard unit is secured to the corresponding side by means of holder metals and set screws. For accommodation of the keyboard unit, one of the side arms is disengaged from one holder metal by removal of the set screw and the keyboard unit is turned downwards about the rear end of the other holder metal in order to be encased in a lower space within the main casing.

With this conventional construction, set screws for the holder metals have to be removed for every accommodation of the keyboard unit. In addition to troublesome manual removal, repeated removal and setting of the set screws makes the threaded holes in the side seriously idle, thereby causing rattle, unstable positioning of the keyboard assembly. In order to avoid such inconveniences, it is thinkable to embed proper nuts in the sides for repeated trouble-free engagement with the set screws. This solution, however, causes increase in parts and troublesome assemblage of the upright piano.

SUMMARY OF THE INVENTION

It is the object of the present invention to enable easy accommodation of a keyboard unit in the main casing of an upright piano for transportation and storage with stable and reliable positioning of the keyboard unit at performance.

In accordance with the basic aspect of the present invention, a keyboard unit is pivoted at the rear end to the main casing of the upright piano in a vertically turnable arrangement and a holder unit is pivotable between the bottom of the keyboard unit and the lower section of the upright piano in a vertically turnable arrangement, whereby the keyboard is held almost horizontally at one state of the holder unit and fully accommodated in the lower space in the main casing at the other state of the holder unit.

DESCRIPTION OF THE PREFERRED EMBODIMENTS

Figure 1:
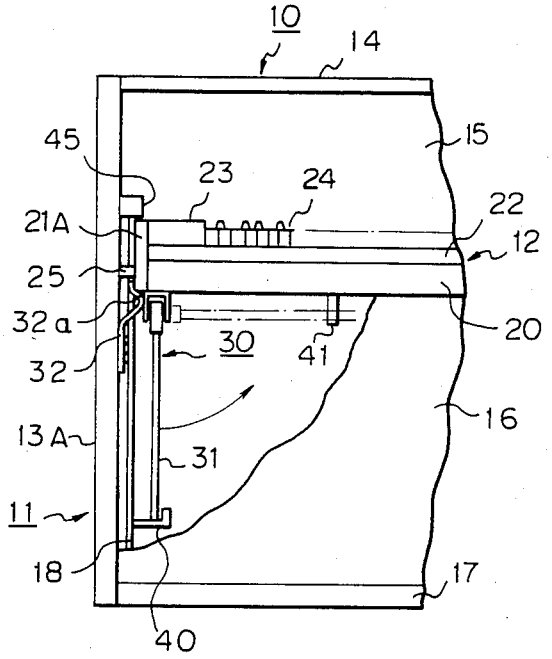
FIG. 1 is a front view, partly removed, of one embodiment of the upright piano in accordance with the present invention.
Figure 2:
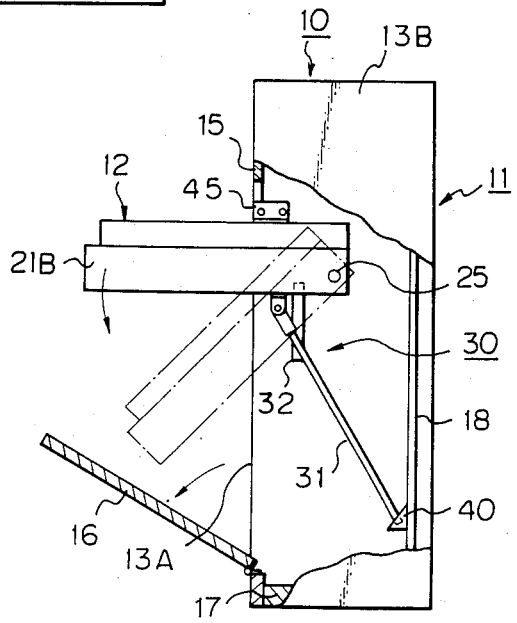
FIG. 2 is a side view, partly removed and partly in section, of the upright piano shown in FIG. 1.

One embodiment of the improved upright piano in accordance with the present invention is shown in FIGS. 1 through 4, in which the upright piano 10 is made up of a main casing 11 and a keyboard unit 12 mounted to the main casing 11 as later described in more detail. The box type main casing 11 includes a pair of sides 13A and 13B, a top board 14, an upper front board 15, a lower front board 16 and, a bottom 17. Within the main casing 11 a plate 18 is almost vertically mounted whilst covering the rear opening of the main casing 11 on which a number of strings are stretched under tension. Further action assemblies (not shown) are also mounted within the main casing 11.

The keyboard unit 12 includes a key bed 20, a pair of side arms 21A and 21B, a key slip 22, a pair of key blocks 23 and a fallboard (not shown). A number of white and black keys 24 are arranged side by side in the keyboard unit 12. The rear end of the keyboard unit 12 is inserted into the interior of the main casing 11 and coupled to the inside surfaces of the sides 13A and 13B via horizontal pins 25 in a vertically pivotal arrangement. Normally, the keyboard unit 12 is supported in a substantially horizontal position suited for performance by a holder unit 30.

The holder unit 30 is arranged below the lateral ends of the keyboard unit 12 and is provided with stays 31 for holding the keyboard unit 12 and bearing springs 32 for provisionally holding the keyboard unit 12.

Figure 3:
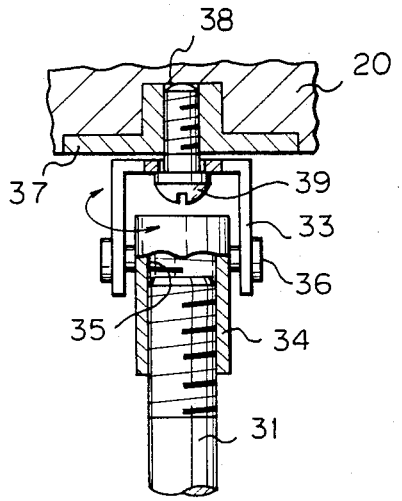
FIG. 3 is a front view, partly in section, of the main part of the holder unit used for the upright piano shown in FIG. 1.

The top end of each stay 31 is pivotally coupled to the bottom of the keyboard unit 12 as shown in FIG. 3. More specifically, a bent bracket 33 is coupled to the bottom of the key bed 20 and a connector tube 34 with a threaded hole 35 is pivotally mounted to the bracket 33 via a horizontal pin 36 extending in the lateral direction of the main casing 11. The top end of the stay 31 is screwed into the threaded hole 35 of the connector tube 34. A holder screw 39 is screwed into a threaded hole 38 of a seat 37 securedly embedded in the bottom of the key bed 20 and holds the bracket 33 in a horizontally turnable fashion.

The lower end of each stay 31 is normally received in a stay seat 40 formed on the side lower end of the plate 18 so that the keyboard unit 12 should be held in the horizontal position. For accommodation of the keyboard unit 12, the lower end of the stray 31 is disengaged from the stay seat 40 and the stay 31 is turned about the horizontal pin 36 towards the bottom of the key bed 20 and held by a holder 41 on the bottom of the key bed 20 as shown with chain lines in FIG. 1.

Each bearing spring 32 is secured at the lower end to the inside surface of the corresponding side 13A or 13B and provided at the upper end with a curved section 32a suited for bearing the side bottom of the keyboard unit 12. The bearing springs 32 are used for provisionally holding the keyboard unit 12 when the latter is not supported by the stays 31 of the holder unit 30. At a level just above the top face of the keyboard unit 12, stoppers 45 are secured to the inside surface of the sides 13A and 13B in order to block upward turning of the keyboard unit 12 beyond the horizontal position.

In preparation for performance of the upright piano 10 in accordance with the present invention, the lower front board 16 is open forwards and the keyboard unit 12 is manually turned upwards and forwards until the bearing springs 32 provisionally take over the hold. Under this condition, stays 31 stored in the space below the key bed 20 are taken out downwards rearwards and their lower ends are brought into engagement with the stay seat 40 on the plate 18. Thereafter, each stay 31 is axially turned in a direction to lift the connector tube 34 until the top face of the keyboard unit 12 abuts against the stoppers 45 on the sides 13A and 13B. Now the keyboard 12 is stably registered at a horizontal position of a prescribed level without any rattle at performance.

For storage of the keyboard unit 12, the stays 31 is turned upwards forwards to disengage their lower ends from the stay seats 40 on the plate 18. After the stays 31 have been completely accommodated in the bottom of the key bed 20, the curved sections 32a of the bearing springs 32 are manually depressed in order to cancel the provisional hold on the keyboard unit 12. Next, the keyboard unit 12 is turned downwards rearwards about the horizontal pins 25 until it is fully accommodated within the main casing 11.

In the case of the foregoing embodiment, a male screw is formed on the upper end of each stay 31 and a female screw is formed in the corresponding connector tube 34. As an alternative, however, each stay 31 may be coupled to the corresponding connector tube 34 by means of a proper connector pin and a proper turnbuckle may be arranged on the body of the stay 31. Any other constructions may be employed as long as they enable free length adjustment.

The present invention is well applicable to upright electric or electronic pianos also.

Figure 4:
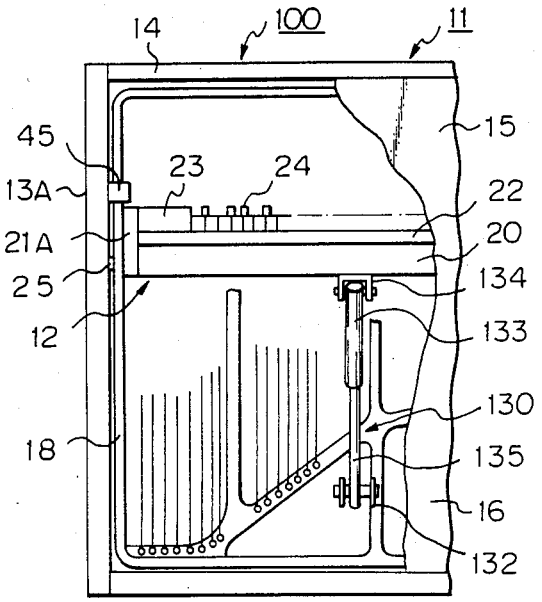
FIG. 4 is a front view, partly removed, of another embodiment of the upright piano in accordance with the present invention.
Figure 5:
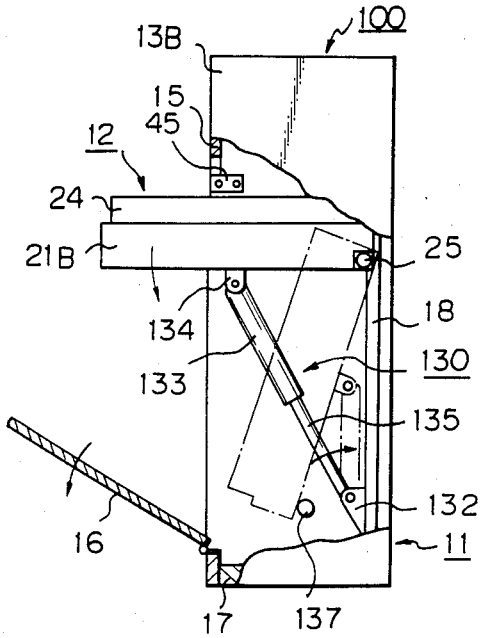
FIG. 5 is a side view, partly removed and partly in section, of the upright piano shown in FIG. 4.

Another embodiment of the upright piano in accordance with the present invention is shown in FIGS. 4 and 5. Since this embodiment differs from the first embodiment in the construction of the holder unit only, like elements are indicated with like reference numerals.

The upright piano 100 is provided with a length-adjustable holder unit 130 which is given in the form of a fluid damper such as an air or oil damper. More specifically, the length adjustable holder unit 130 includes a power cylinder 133 pivoted at the upper end to a bent bracket 134 secured to the bottom of the key bed 20. The piston 135 of the power cylinder 133 is pivoted at the lower end to a bracket 132 on the plate 18. The power cylinder 133 contains high pressure fluid of a compression resistance which is chosen in consideration of the moment of the keyboard unit 12 about the horizontal pins 25. In general, the maximum moment provided by the holder unit 12 is chosen somewhat larger than the above-described moment of the keyboard unit 12. As a substitute for the high pressure fluid, a proper compression spring may be encased in the power cylinder 133.

The length adjustable holder unit 130 may include a plurality of cylinder-piston combinations depending on the size and weight of the keyboard unit 12.

Figure 6:
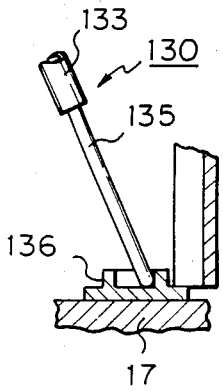
FIG. 6 is a side view, partly removed and partly in section, of a modification of the holder unit shown in FIG. 4.

A modification of the second embodiment is shown in FIG. 6, in which a top open seat 136 is arranged on the bottom 17 as a substitute for the bracket 132. The lower end of the piston 135 is received in the center hollow of the seat 136 for limited sliding in the hollow. This disengageable coupling enables easier mounting of the length-adjustable holder unit 130 when compared with the both ends pivotation in FIGS. 4 and 5.

Further, stoppers 137 are secured to the inside surfaces of the sides 13A and 13B in order to limit the downward turning of the keyboard unit 12 to the lowermost position shown with chain lines in FIG. 5.

For accommodation of the keyboard unit 12, the lower front board 16 is opened forewards and the front end of the keyboard unit 12 is pushed downwards. Then the piston 135 recedes overcoming the compression resistance of the high pressure, or of the compression spring, in the power cylinder 133 and, concurrently, the holder unit 130 as a whole turns upwards rearwards about the pivot on the bracket 132. The keyboard unit 12 continues to turn downwards rearwards until its bottom abuts against the stoppers 137 on the sides 13A and 13B. Thus the keyboard unit 12 is fully accommodated in the main casing 11 at an almost vertical position along the plate 18.

In preparation for performance of the upright piano, the front end of the keyboard unit 12 is manually lifted. Only small manual force is needed for this lifting thanks to the reaction, i.e. recovery from compression, of the length-adjustable holder unit 130. Even when the manual force is cancelled during lifting, the reaction of the holder units 130 slowly returns the keyboard unit 12 to the horizontal position without any impulsive damages on the keyboard unit 12 and its related parts.

Figure 7:
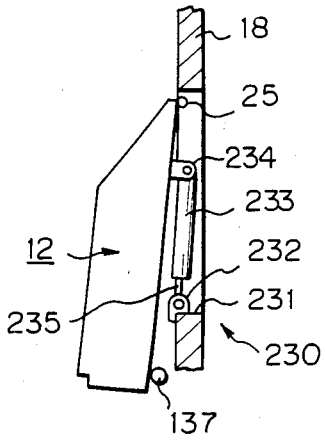
FIG. 7 is a side view, partly in section, of the other embodiment of the holder unit in accordance with the present invention.

The other embodiment of the upright piano in accordance with the present invention is shown in FIG. 7, in which a length-adjustable holder unit 230 is arranged in a storage nook 231 formed in the plate 18. More specifically, the holder unit 230 includes a power cylinder 233 pivoted at the top end to a bent bracket 234 secured to the bottom of the keyboard unit 12 and a piston 235 pivoted at the bottom end to a bracket 232 arranged on the bottom side of the nook 231. The arrangement is adjusted so that, just before full accommodation of the keyboard unit 12, the pivot on the bent bracket 232 should be located behind the straight line connecting the pivot at the horizontal pin 25 and the pivot on the bracket 232. With this specified design, the vector of force provided by the holder unit 230 is directed rearward just before full accommodation so that the keyboard unit can be tidily encased in position.

What is claimed is:

1. An improved upright piano, comprising: a substantially box-type main casing, a plate arranged substantially vertically along the rear side of said main body, a keyboard unit pivoted at its rear end to said main casing in a vertically turnable arrangement, and a holder unit including elongated stays, each of which is pivoted, at one end, to the bottom of said keyboard unit in a vertically turntable arrangement and detachably engaged, at the other end, in a seat mounted on the lower portion of said plate, whereby said keyboard unit is held substantially horizontally when said stay is engaged in said seat, said keyboard, said stay and said seat thereby coupled in a triangular support arrangement, and whereby said keyboard unit is fully accommodated in a lower space in said main casing when said stay is disengaged from said seat.

2. An improved upright piano as claimed in claim 1, wherein said holder unit further includes:

a bracket attached to said bottom of said keyboard unit for free axial rotation and in screw engagement with the top end of said stay.

3. An improved upright piano as claimed in claim 1, wherein said holder unit further includes:

a turnbuckle arranged on said stay, and a bracket attached to said bottom of said keyboard unit for free axial rotation and in pivotal engagement with the top end of said stay.

4. An improved upright piano as claimed in claim 2 or 3, further comprising:

means for provisionally holding said keyboard unit in a horizontal position when said stay is disengaged from said seat.

5. An improved upright piano as claimed in claim 1 or 3, further comprising:

means for blocking said keyboard unit against upward turning beyond a horizontal position.

6. An improved upright piano as claimed in claim 1, wherein said holder unit further includes:

at least one power cylinder with a piston, a first bracket attached to said bottom of said keyboard unit and in pivotal engagement with the top end of said power cylinder, and a member mounted to said main casing and in engagement with the bottom end of said piston.

7. An improved upright piano as claimed in claim 6, wherein said member comprises a second bracket attached to said bottom section of said upright piano and in pivotal engagement with said bottom end of said piston.

8. An improved upright piano as claimed in claim 6, wherein said member comprises a seat on the bottom of said main casing and has a top open hollow for slide reception of said bottom end of said piston.

9. An improved upright piano as claimed in claim 6, wherein:

said plate has a nook, said member comprises a second bracket mounted in said nook and in pivotal engagement with said bottom end of said piston, and said keyboard unit is pivoted to said main casing in said nook in an arrangement such that, just before full accommodation of said keyboard unit in said main casing, the pivot on said first bracket is located behind a straight line extending from said pivot for said keyboard unit to the pivot on said second bracket.

* * * * *